US009904216B2

(12) United States Patent
Yoshida et al.

(10) Patent No.: US 9,904,216 B2
(45) Date of Patent: Feb. 27, 2018

(54) INTERMEDIATE TRANSFER MEMBER AND ELECTROPHOTOGRAPHIC IMAGE FORMING APPARATUS USING THE SAME

(71) Applicant: Konica Minolta, Inc., Tokyo (JP)

(72) Inventors: Eiichi Yoshida, Hino (JP); Sadaaki Sakamoto, Hino (JP); Takayuki Suzuki, Niiza (JP); Ito Koga, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/345,731

(22) Filed: Nov. 8, 2016

(65) Prior Publication Data

US 2017/0139355 A1 May 18, 2017

(30) Foreign Application Priority Data

Nov. 12, 2015 (JP) ..... 2015-221711

(51) Int. Cl.
*G03G 15/20* (2006.01)
*G03G 15/16* (2006.01)
*G03G 15/01* (2006.01)

(52) U.S. Cl.
CPC ..... *G03G 15/162* (2013.01); *G03G 15/0189* (2013.01)

(58) Field of Classification Search
CPC ..... G03G 15/1605; G03G 15/162; G03G 15/0189
See application file for complete search history.

(56) References Cited

U.S. PATENT DOCUMENTS

2012/0014724 A1* 1/2012 Yamashita ..... G03G 15/162 399/308
2015/0220026 A1* 8/2015 Honya ..... G03G 15/1685 399/302

FOREIGN PATENT DOCUMENTS

JP 2011022271 A 2/2011

* cited by examiner

*Primary Examiner* — Hoang Ngo
(74) *Attorney, Agent, or Firm* — Lucas & Mercanti, LLP

(57) ABSTRACT

Provided is an intermediate transfer member used in an electrophotographic image forming apparatus having a unit of primary-transferring a toner image carried on an electrostatic latent image carrier to an intermediate transfer member, and then secondary-transferring the primary-transferred toner image onto a transfer material from the intermediate transfer member, wherein a surface of the intermediate transfer member has a hardness in the range of 150 to 350 MPa, and an elastic modulus in the range of 200 to 600 MPa, which are measured by a nano indentation method, and also has a hardness of 0.5 to 2.0 MPa specified in terms of universal hardness.

10 Claims, 3 Drawing Sheets

INTERMEDIATE TRANSFER MEMBER AND ELECTROPHOTOGRAPHIC IMAGE FORMING APPARATUS USING THE SAME

The entire disclosure of Japanese Patent Application No. 2015-221711 filed on Nov. 12, 2015 including description, claims, drawings, and abstract are incorporated herein by reference in its entirety.

BACKGROUND OF THE INVENTION

Field of the Invention

The present invention relates to an intermediate transfer member, and an electrophotographic image forming apparatus using the same. More specifically, the present invention relates to an intermediate transfer member which generates less cracks and scrapes even if used repeatedly for paper having irregularities, and can transfer the secondary transfer image excellently, and an electrophotographic image forming apparatus using the intermediate transfer member.

Description of the Related Art

As an image forming method of forming an image at a high speed and obtaining a high quality toner image, there is a method of forming an image through a process of developing an electrostatic latent image on an electrostatic latent image carrier with toner supplied by a developing roller, and transferring the formed toner image onto a transfer material such as a paper sheet or the like via a member such as an intermediate transfer member.

For the intermediate transfer member to be used in this image forming method, favorable toner transferability from an electrostatic latent image carrier to an intermediate transfer member, and also from the intermediate transfer member to a transfer material, and further a cleaning performance to finely remove the residual toner after the transferring, are required.

In the electrophotographic image forming apparatus in recent years, various transfer materials are used, and is required to correspond not only to plain paper or OA special paper but also to thick paper, coated paper, and further to some kind of paper such as paper having irregularities on the surface (hereinafter, also referred to as "paper with irregularities"). In particular, the paper with irregularities to which emboss processing has been applied is increasingly used for a business card, a cover of printed matter, and the like because of the peculiar texture.

In order to form a favorable secondary transfer image onto thick paper, or paper with irregularities, use of an intermediate transfer belt capable of absorbing the thickness and irregularities of an object to be transferred (recording paper) as an intermediate transfer member used in an electrophotographic image forming apparatus, can be considered. For example, by giving elasticity to the intermediate transfer belt, a surface of the intermediate transfer belt follows thick paper and paper with irregularities, and improvement of the transferability can be expected.

However, the elastic body has a soft surface and a high frictional property, therefore, when print of a large number of sheets is performed by using paper with irregularities, the surface is scraped, and the expected effect cannot be obtained. As to the countermeasure, it is known that the hardness of an elastic layer on a surface of an intermediate transfer belt is increased, and a coat layer is arranged on a surface of an elastic layer (see, for example, JP 2011-22271 A). However, when the hardness of an elastic layer is increased, the transferability of paper with irregularities is decreased. Further, the coat layer cracks in the bent portion in a copying machine when being extremely hard, and the part cracked in a low density image such as a half-tone image falls out in streak lines. Conversely, when being soft, there is a problem that the surface is scraped by a photoreceptor sliding with an intermediate transfer belt or by a cleaning system, and the transferability is decreased.

SUMMARY OF THE INVENTION

The present invention has been made in view of the above problem and situation, and an object thereof is to provide an intermediate transfer member which generates less cracks and scrapes even if used repeatedly for paper having irregularities, and can transfer the secondary transfer image excellently, and further, to provide an electrophotographic image forming apparatus by using the intermediate transfer member.

As a result of the investigation on the cause of the problem, and the like to solve the problem described above, the present inventors have found that when the surface of an intermediate transfer member having elasticity satisfies certain hardness and elastic modulus, cracks and scrapes are not generated, and the transferability can be ensured for paper having irregularities, and thus have completed the present invention.

Accordingly, the above-described problem according to the present invention can be solved by the following means.

1. To achieve the abovementioned object, according to an aspect, an intermediate transfer member reflecting one aspect of the present invention is used in an electrophotographic image forming apparatus having a unit of primary-transferring a toner image carried on an electrostatic latent image carrier to an intermediate transfer member, and then secondary-transferring the primary-transferred toner image onto a transfer material from the intermediate transfer member, wherein a surface of the intermediate transfer member has a hardness in the range of 150 to 350 MPa, and an elastic modulus in the range of 200 to 600 MPa, which are measured by a nano indentation method, and also has a hardness of 0.5 to 2.0 MPa specified in terms of universal hardness.

2. The intermediate transfer member of Item. 1, wherein the intermediate transfer member preferably has a substrate layer, an elastic layer, and a surface layer.

3. The intermediate transfer member of Item. 1 or 2, wherein the surface layer preferably contains a copolymer of urethane acrylate, and a monomer having an unsaturated double bond other than the urethane acrylate.

4. The intermediate transfer member of any one of Items. 1 to 3, wherein the monomer having an unsaturated double bond other than the urethane acrylate is preferably tetra- or more-functional acrylate.

5. To achieve the abovementioned object, according to an aspect, an electrophotographic image forming apparatus reflecting one aspect of the present invention comprises: performing a process of primary-transferring a toner image carried on an electrostatic latent image carrier to an intermediate transfer member, and then secondary-transferring the primary-transferred toner image to a transfer material from the intermediate transfer member, wherein as the intermediate transfer member, the intermediate transfer member of any one of Items. 1 to 4 is used.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
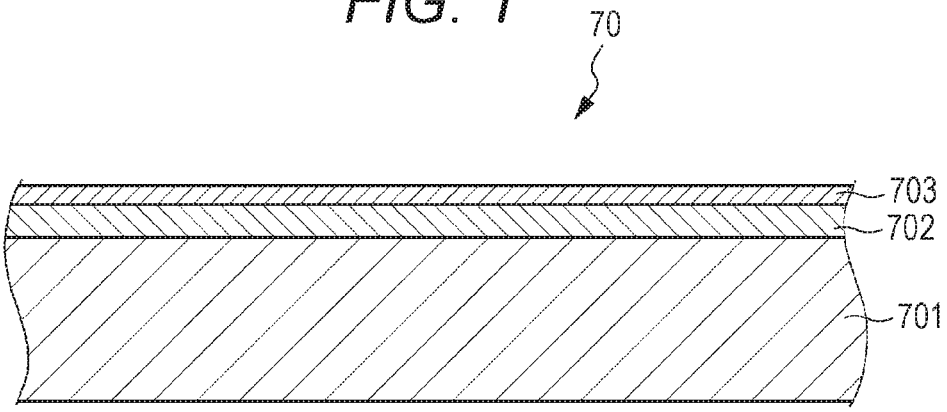
FIG. 1 is a schematic cross-sectional view showing an example of a layer structure of an intermediate transfer member.

Hereinafter, an embodiment of the present invention will be described with reference to the drawings. However, the scope of the invention is not limited to the illustrated examples.

An intermediate transfer member according to the present invention is an intermediate transfer member used in an electrophotographic image forming apparatus having a unit of primary-transferring a toner image carried on an electrostatic latent image carrier to an intermediate transfer member, and then secondary-transferring the primary-transferred toner image onto a transfer material from the intermediate transfer member, in which a surface of the intermediate transfer member has a hardness in the range of 150 to 350 MPa and an elastic modulus in the range of 200 to 600 MPa, which are measured by a nano indentation method, and also has a hardness in the range of 0.5 to 2.0 MPa specified in terms of universal hardness. These features are technical features common to the inventions according to Items. 1 to 5.

As an embodiment of the present invention, from the viewpoint of transferability and durability, it is preferred that the intermediate transfer member has a substrate layer, an elastic layer, and a surface layer. Further, it is preferred that the surface layer contains a copolymer of urethane acrylate and a monomer having an unsaturated double bond other than the urethane acrylate from the viewpoint of elastic deformation amount adjustment.

In addition, in the present invention, it is preferred that the monomer having an unsaturated double bond other than the urethane acrylate is tetra- or more-functional acrylate. As a result, an effect of plastic deformation suppression can be obtained.

An intermediate transfer member of the present invention can be suitably used for an electrophotographic image forming apparatus.

Hereinafter, the present invention and the constituent thereof, and the embodiment for carrying out the present invention will be described in detail. In addition, the term "to" used in the present application is used with the meaning including the numerical values described before and after the "to" as the lower limit value and the upper limit value.

<<Overview of Intermediate Transfer Member>>

An intermediate transfer member according to the present invention is an intermediate transfer member used in an electrophotographic image forming apparatus having a unit of primary-transferring a toner image carried on an electrostatic latent image carrier to an intermediate transfer member, and then secondary-transferring the primary-transferred toner image onto a transfer material from the intermediate transfer member, in which a surface of the intermediate transfer member has a hardness in the range of 150 to 350 MPa and an elastic modulus in the range of 200 to 600 MPa, which are measured by a nano indentation method, and also has a hardness in the range of 0.5 to 2.0 MPa specified in terms of universal hardness.

As a layer structure of an intermediate transfer member of the present invention, it is preferred that an elastic layer and a surface layer are provided on a substrate layer.

FIG. 1 is a schematic cross-sectional view showing an example of a layer structure of an intermediate transfer member.

In FIG. 1, numerals 70, 701 and 702 are designated as an intermediate transfer member, a substrate layer, and an elastic layer, respectively. Numeral 703 is designated as a surface layer. As described above, the constitution in which an elastic layer and a surface layer are placed in this order on a substrate layer is preferred, particularly because of independently controlling the hardness and elastic modulus on the surface of an intermediate transfer member.

The thickness of the intermediate transfer member can be appropriately determined in accordance with the intended use and the like, but in general, is preferably in the range of 150 to 500 μm, which satisfies the mechanical properties such as strength, and flexibility, and more preferably in the range of 200 to 400 μm.

The shape of the intermediate transfer member has an advantage that there is no variation in the thickness of an intermediate transfer belt having an endless structure by superposition, arbitrary portion can be used for the starting position of belt rotation, and the control mechanism of the rotation starting position can be omitted, and the like, and is therefore preferred.

In addition, in the present invention, the surface means a surface onto which a toner image carried on an electrostatic latent image carrier is transferred.

Further, as the paper with irregularities, a sheet having a basis weight in the range of 150 to 300 gsm, and having a surface shape with large irregularities, to which emboss processing or the like has been applied, can be preferably applied.

First, hardness and elastic modulus measured by a nano indentation method according to the present invention, and hardness specified in terms of universal hardness will be described.

<<Hardness and Elastic Modulus Measured by Nano Indentation Method>>

The hardness of the intermediate transfer member of the present invention measured by a nano indentation method is in the range of 150 to 350 GPa, and preferably 200 to 300 GPa. Further, the elastic modulus of the intermediate transfer member measured by a nano indentation method is in the range of 200 to 600 MPa.

In the present invention, as described above, by decreasing the elastic modulus to the specific range while maintaining the hardness of the outermost surface of an intermediate transfer member and by having the hardness specified in terms of universal hardness, the elastic layer is deformed and the followability to paper with irregularities is improved, and an intermediate transfer member which generates less cracks and scrapes even if repeatedly used can be realized.

In a method of measuring hardness by a nano indentation method, the hardness is obtained from the value obtained by measuring the relationship between the load and the push-in depth (amount of displacement) while applying a load to a thin film by using a minute diamond indenter and then removing the load.

Particularly, in a case of a measurement of a thin film having a thickness of 1 μm or less, it has a feature that influence from the properties of a substrate is hardly received, and cracks are hardly generated on the thin film when the indenter is pushed therein. This method is generally used for a measurement of physical properties of an extremely thin film.

Figure 2:
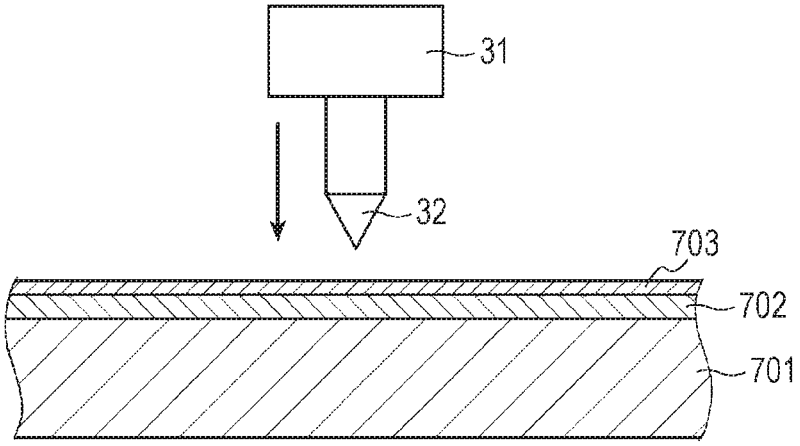
FIG. 2 is a schematic diagram showing an example of a measuring device employing a nano indentation method.

FIG. 2 is a schematic diagram showing an example of a measuring device employing a nano indentation method.

With this measuring device, the amount of displacement can be measured with the accuracy of nanometer while applying a load in μN by using a transducer 31 and a 90° Cube Corner Tip indenter 32. For this measurement, for example, a commercially available "Triboscope" (manufactured by Hysitron, Inc.) can be used.

Figure 3:
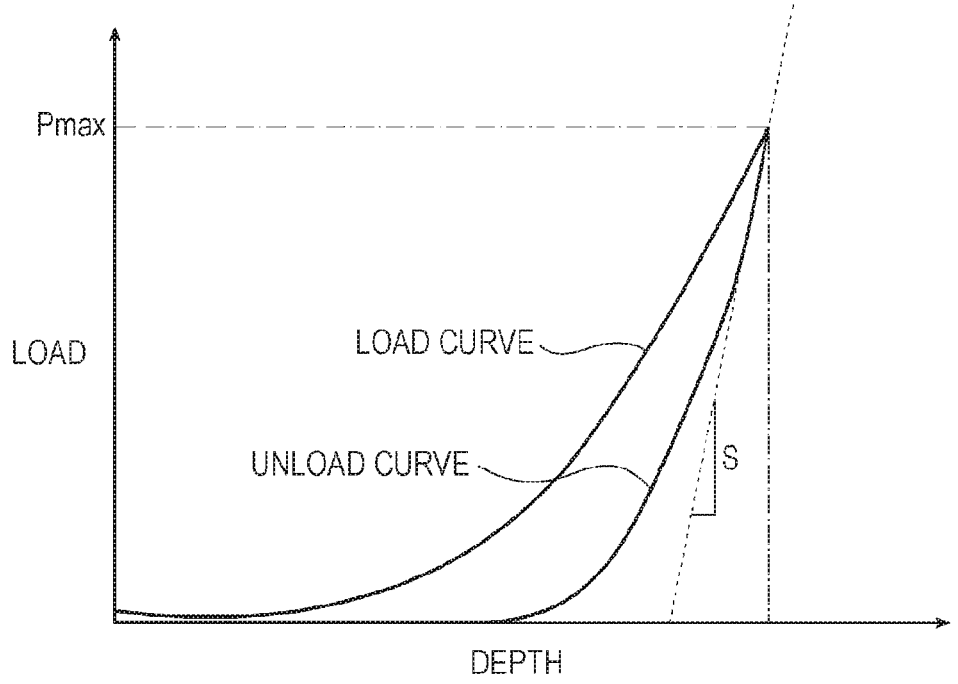
FIG. 3 shows a typical load-displacement curve obtained by a nano indentation method.

FIG. 3 shows a typical load-displacement curve obtained by a nano indentation method.

Figure 4:
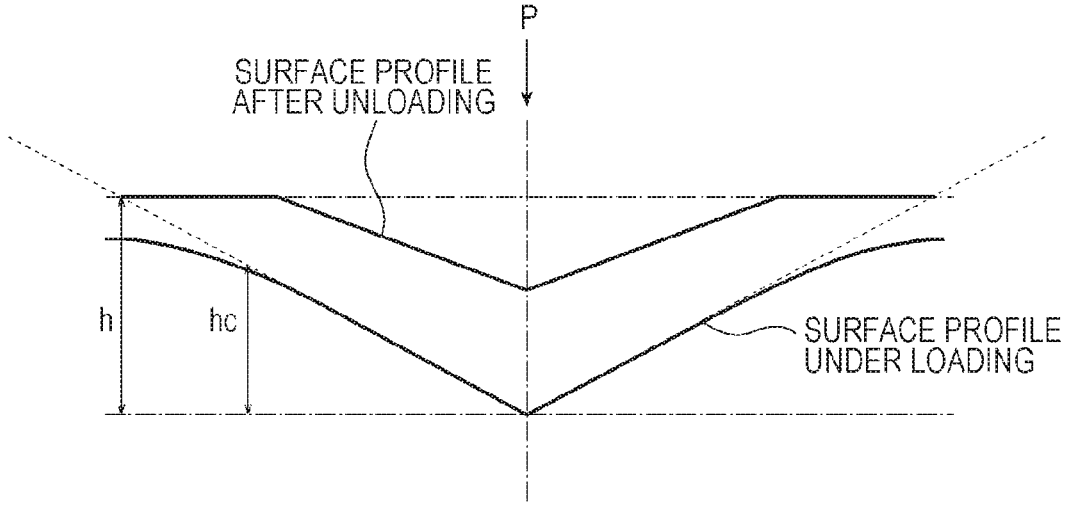
FIG. 4 is a schematic diagram showing a state in contact between an indenter and a sample.

FIG. 4 is a schematic diagram showing a state in contact between an indenter and a sample.

(Measurement of Hardness)

The hardness H measured by a nano indentation method can be calculated by the following Equation (1).

$$H=P\max/A \qquad \text{Equation (1)}$$

where P is the maximum load applied to an indenter, and A is the contact projection area between the indenter and a sample at this time.

The contact projection area A can be expressed by the following Equation (2), using hc in FIG. 4.

$$A=24.5hc^2 \qquad \text{Equation (2)}$$

where hc is shallower than the total push-in depth h due to the elastic indentation of the periphery surface of a contact point as shown in FIG. 4, and is expressed by the following Equation (3).

$$hc=h-hs \qquad \text{Equation (3)}$$

where hs is an amount of the indentation caused by elasticity, and is expressed by the following Equation (4), $$hs=\epsilon\times P/S \qquad \text{Equation (4)}$$

using a load curve slope after pushing an indenter (slope S in FIG. 4) and the indenter shape.

Herein, $\epsilon$ is a constant concerning the indenter shape, and is 0.75 in a case of a 90° Cube Corner Tip indenter.

The hardness of the surface of an intermediate transfer member can be measured by using such a measuring device.

(Measurement of Elastic Modulus)

The elastic modulus E measured by a nano indentation method can be calculated from the following Equation (5).

$$\epsilon=\pi^{1/2}\cdot S/(\beta\cdot 2\cdot A^{1/2}) \qquad \text{Equation (5)}$$

where S is contact stiffness, A is projected area of contact, and β is a constant determined depending on the indenter shape. β=1.012 in a case of a quadrangular pyramid indenter.

The contact stiffness S can be determined from the slope by measuring the relationship between a load and push-in depth (amount of displacement) while applying a load to a minute diamond indenter and then removing the load (see FIG. 3).

(Measurement Conditions)

Measuring instrument: Triscope (manufactured by Hysitron, Inc.)

Measurement indenter: 90° Cube Corner Tip indenter

Measurement environment: 20° C., and 60% RH

Measurement sample: prepared by cutting an intermediate transfer member into a size of 5 cm×5 cm Maximum load setting: 30 μN Push-in speed: applying a load in proportion to time at a speed to reach the maximum load of 25 μN in 5 seconds In addition, for all data items, the measurement is performed at 10 random positions, and the average value is designated as the hardness obtained by a measurement with a nano indentation method.

<<Universal Hardness>>

The universal hardness of an intermediate transfer member of the present invention is in the range of 0.5 to 2.0 MPa.

The hardness specified in terms of universal hardness is obtained from the following Equation (6) by pushing an indenter into an object to be measured while applying a load, $$\text{Universal hardness}=(\text{test load})/(\text{contact surface area of an indenter with an object to be measured under a test load}), \qquad \text{Equation (6)}$$

and the unit is expressed by MPa ($N/mm^2$). The universal hardness can be measured by using a commercially available hardness measuring device. For example, an ultra-micro hardness meter "H-100V" (manufactured by Fischer Instruments K.K.) can be used for this measurement. In a case of this measuring device, an indenter with a quadrangular or triangular pyramid shape is pushed into an object to be measured while applying a test load to the indenter, the surface area of the indenter being in contact with the object to be measured is calculated from the push-in depth when the depth reaches the intended depth, and the universal hardness is calculated from above-described Equation (6).

Measurement Conditions

Measuring instrument: hardness meter pushed-in tester "H-100V" (manufactured by Fischer Instruments K.K.)

Measurement indenter: Vickers indenter

Measurement environment: 20° C., and 60% RH

Measurement sample: prepared by cutting an intermediate transfer member into a size of 5 cm×5 cm Maximum test load: 2 mN Loading conditions: applying a load in proportion to time at a speed to reach the maximum test load in 10 seconds Creep time under load: 5 seconds In addition, for all data items, the measurement is performed at 10 random positions, and the average value is designated as the hardness specified in terms of universal hardness.

Next, the layer structure of an intermediate transfer member of the present invention, the composition of each layer, and the method of preparing an intermediate transfer member will be described.

<<Layer Structure of Intermediate Transfer Member>>

It is preferred that an intermediate transfer member of the present invention has a substrate layer, an elastic layer, and a surface layer. By employing the layer structure, an intermediate transfer member satisfying both the plastic deformation hardness and elastic modulus measured by a nano indentation method, and the universal hardness is easily obtained.

Hereinafter, each of the layers constituting an intermediate transfer member will be described.

<Substrate Layer>

A substrate layer of the present invention is not particularly limited, and prepared with a known forming method by using a known material.

Examples of the known material include a resin material such as polycarbonate, polyphenylene sulfide, polyvinylidene fluoride, polyimide, polyether, and ether ketone, and a resin containing polyphenylene sulfide as the main component.

Examples of the known method include a forming method of applying a coating liquid in which a resin is dissolved in a solvent, and a method of directly forming a film with a resin, and the method of directly forming a film is preferred.

Examples of the method of forming a substrate layer by directly forming a film with a resin include an extrusion molding method, and an inflation molding method. In any cases of the above, a resin material is molten and kneaded with various conductive substances, and the resultant resin is extruded and cooled to forma substrate layer in a case of using an extruder, and the resultant molten resin is made into a cylinder shape in a mold, and air is blown into the cylinder shape by a blower, and the resultant resin is cooled and formed into an endless belt shape in a case of an inflation method. A substrate layer can be prepared as described above.

Hereinafter, a substrate layer employing a resin obtained by using polyphenylene sulfide as the main component, and a method of preparing a substrate layer by an extrusion molding method will be described.

The substrate layer using polyphenylene sulfide as the main component is formed of polyphenylene sulfide, a graft copolymer made of an epoxy group-containing olefin copolymer and a vinyl (co)polymer, a conductive filler, and a lubricant.

Polyphenylene sulfide (PPS) used in the present invention is a thermoplastic plastic having a structure of alternately arranging a phenylene unit and a sulfur atom.

The phenylene unit is an o-phenylene unit, an m-phenylene unit, or a p-phenylene unit, which may contain a substituent, and these units may be used in a mixture. A preferable phenylene unit contains at least a p-phenylene unit, and the content is 50% or more based on the total phenylene units. It is preferred that the phenylene unit is made only of particularly an unsubstituted p-phenylene unit.

As a conductive filler to be used in the present invention, carbon black can be used. As the carbon black, neutral carbon black can be used. As to the use amount of the conductive filler, the conductive filler may be added so that the volume resistance value and surface resistance value of an intermediate transfer member are in the predetermined range, although the use amount differs depending on the kind of the conductive filler to be used. The use amount of the conductive filler is usually in the range of 10 to 20 parts by mass, and preferably in the range of 10 to 16 parts by mass based on 100 parts by mass of polyphenylene sulfide.

The lubricant to be used in the present invention is a lubricant for improving the moldability of an intermediate transfer member, and includes, for example, aliphatic hydrocarbon-based wax such as paraffin wax, and polyolefin wax; a higher fatty acid such as lauric acid, myristic acid, palmitic acid, stearic acid, and behenic acid; and a higher fatty acid metal salt such as a sodium salt of the higher fatty acid, a lithium salt of the higher fatty acid, and a calcium salt of the higher fatty acid. These lubricants may be used alone or in combination of two or more kinds. The use amount of the lubricant is in the range of 0.1 to 0.5 parts by mass, and preferably in the range of 0.1 to 0.3 parts by mass based on 100 parts by mass of polyphenylene sulfide.

As to the substrate layer according to the present invention, an annular die is installed in a single-screw extruder, a mixture including the above-described materials is charged into the extruder, and a molten resin composition is extruded from a seamless belt-shaped resin discharge opening at the top of the annular die. After that, the extruded resultant is solidified by extrapolating to a cooling cylinder having a cooling mechanism, and the seamless cylindrical shape can be easily formed.

At this time, as an arrangement for avoiding the crystallization, it is preferred to cool the resultant with water, air, a cooled metal block, or the like immediately after the belt is discharged from a metal mold. Specifically, by using a cooling cylinder attached to a metal mold by sandwiching a heat insulating material therebetween, the heat can be rapidly taken away from the belt. Water adjusted to a temperature of 30° C. or less is circulated at all times inside the cooling cylinder. Further, by taking the belt discharged from a metal mold at a high speed to make a thinner film, the cooling rate may be increased. In this case, the taking speed is 1 m/min or more, and in particular, preferably in the range of 2 to 7 m/min.

In a case where the value of a ratio of an annular die diameter ΦD to a cooling cylinder diameter Φd, D/d is in the range of 0.9 to 1.1, the resin extruded from the annular die to the cooling cylinder is taken by a taking device while being introduced outside. At the time, in a case where the D/d is in the range of 0.9 to 0.98, it is required to perform vacuum drawing in a space between the annular die and the cooling cylinder in order to make the resin moving along the cooling cylinder. However, in a case where the D/d is in the range of 0.99 to 1.02, the resin can be moved along the cooling cylinder without performing vacuum drawing in a space between the annular die and the cooling cylinder, and further, pulsation in vacuum drawing is not generated, and it becomes advantageous in hardly generating film thickness variation in the taking direction.

<Elastic Layer>

The elastic layer in an intermediate transfer member of the present embodiment can be obtained by a foam body of a material having thermoplastic elastomer (TPE) as the main component, a material having vulcanized rubber as the main component, or a polymer material.

Examples of the thermoplastic elastomer (TPE) include styrene-based TPE such as a styrene-butadiene block copolymer (SBS), and styrene-ethylene-butylene-styrene block copolymer (SEBS), urethane-based TPE (TPU), olefin-based TPE (TPO), polyester-based TPE (TPEE), polyamide-based TPE, fluorine-based TPE, and vinyl chloride-based TPE. These can be used alone or in combination of two or more kinds.

The vulcanized rubber is not particularly limited as long as it is a polymer material showing rubber elasticity by the vulcanization, and examples of the polymer material include natural rubber (NR), butadiene rubber (BR), acrylonitrile butadiene rubber (NBR), hydrogenated NBR (H-NBR), styrene butadiene rubber (SBR), isoprene rubber (IR), urethane rubber, chloroprene rubber (CR), chlorinated polyethylene (Cl-PE), epihalohydrin rubber (ECO, CO), butyl rubber (IIR), ethylene propylene diene polymer (EPDM), fluororubber, silicone rubber, acrylic rubber (ACM).

Examples of the silicone rubber include addition type liquid silicone rubber, and specifically include KE-106 and KE1300 manufactured by Shin-Etsu Chemical Co., Ltd.

Examples of the butyl rubber include an isobutylene-isoprene copolymer.

The acrylic rubber is a rubber elastic body obtained by polymerization of acrylic ester, or copolymerization mainly using the acrylic ester.

Examples of the urethane rubber include polyester-based urethane rubber (AU) in which the main chain has an ester bond, and polyether-based urethane rubber (EU) in which the main chain has an ether bond.

Examples of the ECO include an epihalohydrin homopolymer, and a copolymer of epihalohydrin and an alkylene oxide and/or allyl glycidyl ether. Representative examples of the ECO include an epichlorohydrin homopolymer, an epibromohydrin homopolymer, an epichlorohydrin-ethylene oxide copolymer, an epichlorohydrin-propylene oxide copolymer, an epichlorohydrin-allyl glycidyl ether copolymer, an epichlorohydrin-ethylene oxide-propylene oxide copolymer, and an epichlorohydrin-ethylene oxide-allyl glycidyl ether copolymer.

Among them, when considering expansion and contraction fatigue, permanent strain, and bending cracks, the material of the elastic layer is preferably at least one kind of silicone rubber, fluororubber, butyl rubber, nitrile rubber, chloroprene rubber, urethane rubber, and acrylic rubber.

The elastic layer preferably contains a conductive agent. Examples of the conductive agent dispersed in the elastic layer include a conductive carbon-based substance such as carbon black, and graphite, a metal or alloy such as aluminum, and a copper alloy, and further a conductive metal oxide such as tin oxide, zinc oxide, antimony oxide, indium oxide, potassium titanate, an antimony oxide-tin oxide composite oxide (ATO), and an indium oxide-tin oxide composite oxide (ITO). These fine powders can be used singly or in combination of two or more kinds. Among them, a conductive carbon-based substance is preferred and carbon black is more preferred.

The average particle diameter of the conductive agent is, in view of the impartment of the electric characteristics that is suitable for an intermediate transfer member, preferably in the range of 20 to 150 nm, more preferably in the range of 23 to 140 nm, and furthermore preferably in the range of 25 to 130 nm. Further, in the present specification, the average particle diameter of the conductive agent can be measured by a method of FPAR-1000 (manufactured by Otsuka Electronics Co., Ltd.) using a photon counting system.

The content of the conductive agent in an elastic layer is, in view of the impartment of the electric characteristics that is suitable for an intermediate transfer member, preferably in the range of 5 to 35% by mass, more preferably in the range of 10 to 30% by mass, and furthermore preferably in the range of 15 to 25% by mass. Further, the content of the conductive agent in an elastic layer can be measured by TG-DTA.

In addition, a curing agent can be added into the elastic layer if necessary. For example, in a case of silicone rubber, examples of the curing agent include hydrogen organopolysiloxane, and in a case of urethane rubber, aliphatic diamine, diisocyanate, or polyol can be used as the curing agent. Further, in a case of butyl rubber, aliphatic diamine, or aromatic diamine can be used as the curing agent. Furthermore, in a case of chloroprene rubber, aliphatic diamine, or aromatic diamine can be used as the curing agent. These curing agents may be mixed into the layer material and used.

The thickness of the elastic layer is not particularly specified as long as an object of the present invention can be achieved, and is, in consideration of the function of the intermediate transfer member capable of flexibly corresponding to the thickness of paper and the paper with irregularities, preferably in the range of 150 to 400 μm, and more preferably in the range of 150 to 300 μm.

<Surface Layer>

The surface layer according to the present invention is not particularly limited as long as the above-described hardness and elastic modulus measured by a nano indentation method, and the hardness specified in terms of universal hardness are obtained, and urethane acrylate is preferred as the resin forming a preferable surface layer.

The urethane acrylate can be used as long as it has a urethane bond and is further a high molecular compound having one or more acryloyloxy groups in one molecule without particular limitation.

For example, an oligomer or a polymer, which has a urethane bond in the main chain, and one or more acryloyloxy groups are bonded to an end of the main chain or in aside chain, can be used.

The urethane acrylate can be obtained, for example, by polymerizing an alcohol component and a polyvalent isocyanate compound, and an acid component and acrylate.

Specifically, the urethane acrylate can be obtained by reacting polyurethane having a hydroxyl group at the end, which is obtained by polymerizing a polyvalent isocyanate compound, an acid component, and an excessive alcohol component, with acrylic acid, methacrylic acid, a (meth) acrylate having a carboxyl group, a (meth) acrylate having a glycidyl group such as glycidyl (meth)acrylate, or a (meth)acrylate having an isocyanate group.

Further, the urethane acrylate can be obtained by reacting polyurethane having an isocyanate group at the end, which is obtained by polymerizing an alcohol component, an acid component, and an excessive polyvalent isocyanate compound, with a compound having a hydroxyl group and a reactive double bond or a (meth)acrylate having a carboxyl group.

The production method of urethane acrylate is not limited to these.

As the alcohol component, for example, 1,6-hexanediol, pentaerythritol, polybutylene glycol, polypropylene glycol, tetramethylene glycol, 1,4-butanediol, 1,5-pentanediol, neopentyl glycol, 1,4-cyclohexanedimethanol, 2-methyl-1,8-octanediol, 1,9-nonanediol, 3-methyl-1,5-pentanediol, polytetramethylene glycol, an ethylene glycol-propylene glycol block copolymer, an ethylene glycol-tetramethylene glycol copolymer, methyl pentanediol modified polytetramethylene glycol, propylene glycol modified polytetramethylene glycol, a propylene oxide adduct of bisphenol A, a propylene oxide adduct of hydrogenated bisphenol A, a propylene oxide adduct of bisphenol F, a propylene oxide adduct of hydrogenated bisphenol F, or the like can be used.

These alcohol components can be used singly or in combination of two or more kinds.

As the polyvalent isocyanate compound, for example, diisocyanate such as isophorone diisocyanate, tolylene diisocyanate, xylylene diisocyanate, diphenylmethane diisocyanate, hexamethylene diisocyanate, trimethylhexamethylene diisocyanate, tetramethylxylylene diisocyanate, hydrogenated tolylene diisocyanate, hydrogenated xylylene diisocyanate, hydrogenated diphenylmethane diisocyanate, and norbornene diisocyanate, further a polymer of the above-described diisocyanate, a urea modified product of diisocyanate, a biuret modified product, or the like can be used.

These polyvalent isocyanate compounds can be used singly or in combination of two or more kinds.

As the acid component, dicarboxylic acid can be used. The dicarboxylic acid may either be any dicarboxylic acid having carboxyl groups at both ends of a divalent substituent derived from alkane, alkene, alkyne or the like, or an aromatic dicarboxylic acid compound having an aromatic group, and having a carboxyl group at the end.

For example, adipic acid, sebacic acid, or the like can be used.

As the aromatic dicarboxylic acid compound, one or more kinds selected from the group consisting of isophthalic acid, and naphthalene dicarboxylic acid (provided that 1,4-naphthalene dicarboxylic acid, 1,5-naphthalene dicarboxylic acid, and 2,6-naphthalene dicarboxylic acid are excluded) can be used. In particular, it is preferred to use isophthalic acid, 1,3-naphthalene dicarboxylic acid, 1,6-naphthalene dicarboxylic acid, 1,7-naphthalene dicarboxylic acid, or 2,7-naphthalene dicarboxylic acid, and particularly, isophthalic acid is preferably used, from the viewpoint of realizing an intermediate transfer member, which is strong against scraping and excellent in wear resistance.

The use ratio of dicarboxylic acid compound is preferably in the range of 0.03 to 0.3 mol, and more preferably in the range of 0.05 to 0.2 mol based on one mol of the polymer of an alcohol component and a polyvalent isocyanate compound, which are used for forming urethane acrylate.

These acid components can be used singly or in combination of two or more kinds.

Examples of the compound having a hydroxyl group and a reactive double bond include an acrylic acid derivative such as 2-hydroxyethyl acrylate, 2-hydroxypropyl acrylate, 3-hydroxypropyl acrylate, 4-hydroxybutyl acrylate, polyethylene glycol monoacrylate, polypropylene glycol monoacrylate, ethylene glycol-propylene glycol.block copolymer monoacrylate, ethylene glycol-tetramethylene glycol copolymer monoacrylate, caprolactone modified monoacrylate, and pentaerythritol triacrylate, and a methacrylic acid derivative such as 2-hydroxyethyl methacrylate, 2-hydroxypropyl methacrylate, 3-hydroxypropyl methacrylate, 4-hydroxybutyl methacrylate, polyethylene glycol monomethacrylate, polypropylene glycol monomethacrylate, ethylene glycol-propylene glycol.block copolymer monomethacrylate, ethylene glycol-tetramethylene glycol copolymer monomethacrylate, caprolactone modified monomethacrylate, and pentaerythritol trimethacrylate. These can be used singly or in combination of two or more kinds.

Among the above-described urethane acrylates, urethane acrylate having acryloyl groups at both ends of the molecule chain has preferably a weight average molecular weight in the range of 3000 to 10000, and more preferably a weight average molecular weight in the range of 3000 to 5000.

Further, as to the urethane acrylate contained in a surface layer, urethane acrylate having a 4 or more functional acryloyl group or methacryloyl group in one molecule is preferred because the crosslinking density increases, and an intermediate transfer member, which is strong against scraping and excellent in wear resistance, is easily obtained.

Examples of the urethane acrylate include polyol type urethane acrylate. Further, as a commercially available product, for example, UV curable urethane acrylate manufactured by The Nippon Synthetic Chemical Industry Co., Ltd. can be used.

In addition, it is preferred that the surface layer contains a copolymer of the above-described urethane acrylate and a monomer having an unsaturated double bond other than the urethane acrylate. Further, the monomer having an unsaturated double bond other than the urethane acrylate is preferably tetra- or more-functional acrylate.

Examples of the monomer having an unsaturated double bond other than the urethane acrylate include ditrimethylolpropane tetraacrylate, ethoxylated pentaerythritol tetraacrylate, pentaerythritol tetraacrylate, dipentaerythritol polyacrylate, dipentaerythritol hexaacrylate, and ϵ-caprolactone modified dipentaerythritol hexaacrylate.

The mass ratio of monomer having an unsaturated double bond other than the urethane acrylate/urethane acrylate is preferably in the range of 50/50 to 70/30.

The thickness of the surface layer is not particularly specified as long as an object of the present invention can be achieved, and is preferably in the range of 1 to 7 μm, and more preferably in the range of 2 to 5 μm.

The weight average molecular weight of urethane acrylate is a value measured by a gel permeation chromatography method.

<Forming Method of Surface Layer>

The surface layer according to the present invention can be obtained by forming a coated film layer having urethane acrylate, a monomer having an unsaturated double bond other than the urethane acrylate, an additive, and a polymerization initiator, and then by irradiating the coated film layer with UV rays or electron beams.

Examples of the polymerization initiator for the UV curable resin include benzophenone, Michler's ketone, 1-hydroxycyclohexyl-phenylketone, thioxanthone, benzobutyl ether, acyloxime ester, dibenzofulvene, and bisacylphosphine oxide.

The surface layer can be formed by adding an additive such as a conductive substance, an inorganic filler, and an electric resistance adjusting agent, if necessary.

As to the surface layer, the hardness and elastic modulus measured by a nano indentation method, and the hardness specified in terms of universal hardness can be controlled by UV curable urethane acrylate and a monomer having an unsaturated double bond other than urethane acrylate, which are used for forming the surface layer, and the composition ratio thereof, and the kind and amount of a polymerization initiator, the layer thickness, the UV curing conditions, and the kind and amount of a conductive substance, an inorganic filler, and an electric resistance adjusting agent, which are added if necessary.

In particular, the hardness and elastic modulus measured by a nano indentation method, and the hardness specified in terms of universal hardness are influenced by the kind of urethane acrylate acrylic monomer, and the composition ratio thereof, UV curing conditions, and the like.

A method of arranging a surface layer on a substrate layer is preferably a method in which a substrate layer is spray-coated with a coating liquid for a surface layer to form a coated film, primary drying is performed on the coated film to the extent that the fluidity of the coated film is eliminated, and then irradiation with UV rays is performed to cure the UV curable resin, further secondary drying is performed in order that the amount of the volatile substance in the coated film is to be the defined amount, and the surface layer is prepared.

The spray coating liquid can be prepared by mixing urethane acrylate, a monomer having an unsaturated double bond other than the urethane acrylate, a polymerization initiator, a diluting solvent, and if necessary, a conductive substance, an inorganic filler, and an electric resistance adjusting agent, and then dispersing the mixture by using a sand mill or a stirring device.

The diluting solvent is not particularly limited as long as it dissolves a UV curable urethane acrylate, a monomer having an unsaturated double bond other than the urethane acrylate, and a polymerization initiator, and specific examples of the diluting solvent include n-butyl alcohol, isopropyl alcohol, ethyl alcohol, methyl alcohol, methyl isobutyl ketone, and methyl ethyl ketone.

As the apparatus for UV irradiation, a known apparatus that is used for curing a UV curable resin can be used.

The dose of UV rays (mJ/cm$^2$) for UV curing the resin is preferably controlled by the UV irradiation intensity and the irradiation time.

<<Image Forming Method, and Image Forming Apparatus>>

Next, an image forming method and an image forming apparatus according to the present invention will be described.

The image forming apparatus preferably has on an electrostatic latent image carrier (hereinafter, also referred to as "photoreceptor") a charging unit, an exposure unit, a developing unit using a developing agent containing small-diameter toner, and a transfer unit that transfers a toner image formed by the developing unit onto a transfer material via an intermediate transfer member.

Specific examples of the image forming apparatus include a copying machine, and a laser printer, and particularly, an image forming apparatus capable of continuously printing 5000 sheets or more is preferred. In such the apparatus, an electric field is easily generated between the intermediate transfer member and the transfer material because a large number of prints are performed in a short period of time. However, generation of the electric field is suppressed by the intermediate transfer member of the present invention, and stable secondary transfer can be performed.

The image forming apparatus capable of using the intermediate transfer member of the present invention has a photoreceptor on which an electrostatic latent image corresponding to image information is formed, a developing device that develops the electrostatic latent image formed on the photoreceptor, a primary transfer unit that transfers a toner image on the photoreceptor onto an intermediate transfer member, a secondary transfer unit that transfers the toner image on the intermediate transfer member onto a transfer material such as a paper sheet, and an OHP sheet, and the like. Further, by having an intermediate transfer member of the present invention as the intermediate transfer member, stable toner image forming can be performed without generating peeling discharge during the secondary transfer.

Examples of the image forming apparatus capable of using the intermediate transfer member of the present invention include a monochrome image forming apparatus that performs image forming with monochrome toner, a color image forming apparatus that transfers toner images on a photoreceptor sequentially onto the intermediate transfer member, and a tandem type color image forming apparatus in which plural photoreceptors for every color are arranged in series on the intermediate transfer member.

An intermediate transfer member of the present invention is effective when used for a tandem type color image forming.

Figure 5:
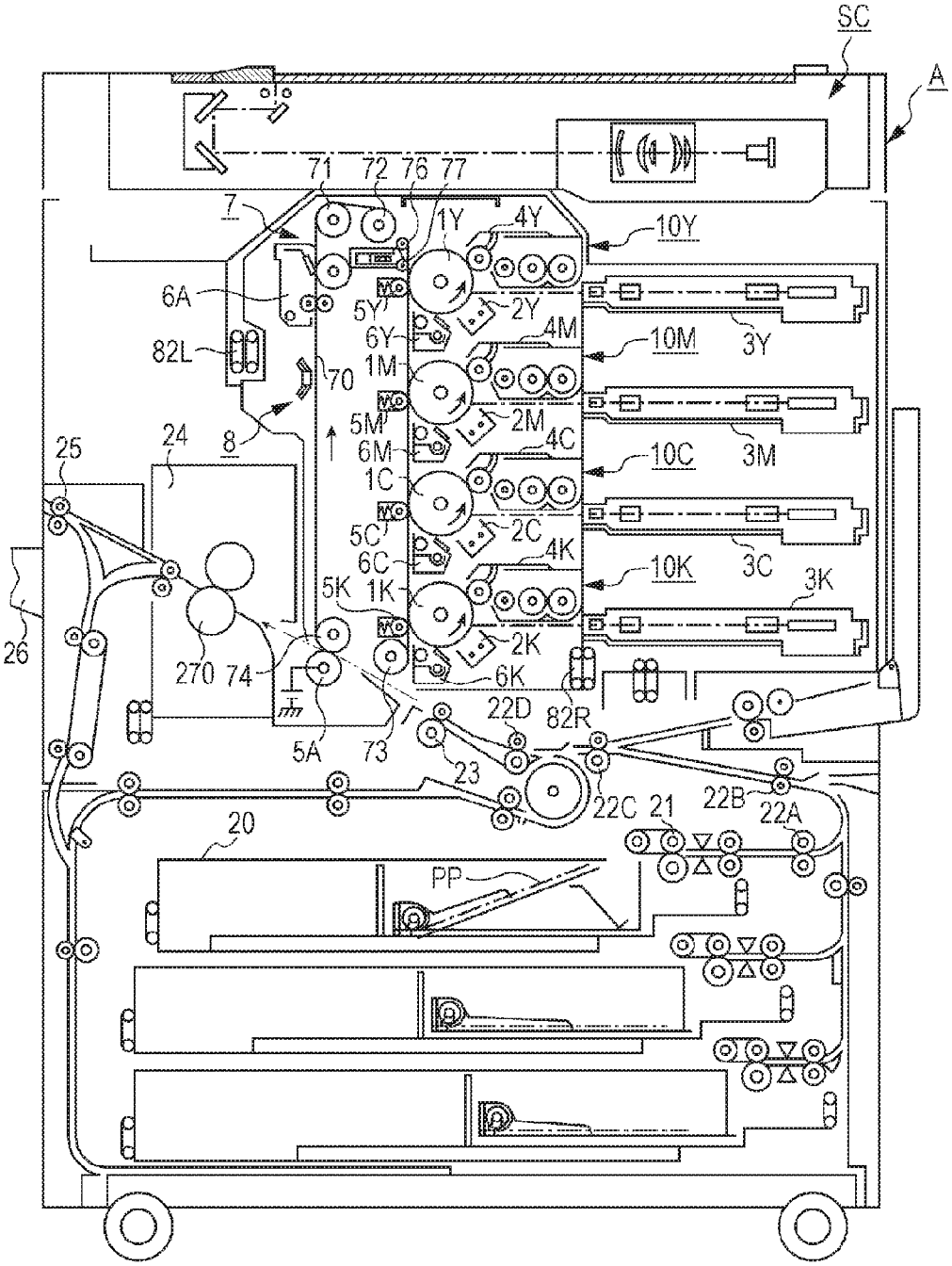
FIG. 5 is a cross-sectional diagram showing an example of an image forming apparatus capable of using an intermediate transfer member according to an embodiment of the present invention.

FIG. 5 is a cross-sectional diagram showing an example of an image forming apparatus capable of using the intermediate transfer member of the present invention.

In FIG. 5, each of reference numerals 1Y, 1M, 1C, and 1K represents a photoreceptor, each of reference numerals 4Y, 4M, 4C, and 4K represents a developing unit, each of reference numerals 5Y, 5M, 5C, and 5K represents a primary transfer roller as a primary transfer unit, reference numeral 5A represents a secondary transfer roller as a secondary transfer unit, each of reference numerals 6Y, 6M, 6C, and 6K represents a cleaning unit, reference numeral 7 represents an intermediate transfer unit, reference numeral 24 represents a heat roll-type fixing device, and reference numeral 70 represents an intermediate transfer member.

This image forming apparatus is called a tandem type color image forming apparatus, and has plural sets of image forming sections 10Y, 10M, 10C, and 10K, an endless belt type intermediate transfer unit 7 as a transfer section, an endless belt type paper feeding conveying unit 21 that conveys a recording member PP, and a heat roll-type fixing device 24 as a fixing unit. On the upper part of main body A of the image forming apparatus, a document image reading device SC is arranged.

As one of the toner images in different colors, which is formed on each one of the photoreceptors, the image forming section 10Y that forms a yellow color image has a drum-shaped photoreceptor 1Y as a first photoreceptor, a charging unit 2Y arranged around the photoreceptor 1Y, an exposure unit 3Y, a developing unit 4Y, a primary transfer roller 5Y as a primary transfer unit, and a cleaning unit 6Y. Further, as one of the toner images in different colors, the image forming section 10M that forms a magenta color image has a drum-shaped photoreceptor 1M as a first photoreceptor, a charging unit 2M arranged around the photoreceptor 1M, an exposure unit 3M, a developing unit 4M, a primary transfer roller 5M as a primary transfer unit, and a cleaning unit 6M. Furthermore, as one of the toner images in different colors, the image forming section 10C that forms a cyan color image has a drum-shaped photoreceptor 1C as a first photoreceptor, a charging unit 2C arranged around the photoreceptor 1C, an exposure unit 3C, a developing unit 4C, a primary transfer roller 5C as a primary transfer unit, and a cleaning unit 6C. Moreover, as one of the toner images in different colors, the image forming section 10K that forms a black color image has a drum-shaped photoreceptor 1K as a first photoreceptor, a charging unit 2K arranged around the photoreceptor 1K, an exposure unit 3K, a developing unit 4K, a primary transfer roller 5K as a primary transfer unit, and a cleaning unit 6K.

The endless belt type intermediate transfer unit 7 is wound on plural rollers, and has an endless belt type intermediate transfer member 70 as a rotatably-supported intermediate transfer endless belt type second image carrier.

The images in respective colors formed respectively by image forming sections 10Y, 10M, 10C, and 10K are transferred sequentially onto a rotatable endless belt type intermediate transfer member 70 by the primary transfer rollers 5Y, 5M, 5C, and 5K, and a combined color image is formed. A recording member PP such as a sheet as a transfer material housed in a paper feeding cassette 20 is fed by a paper feeding conveying unit 21, conveyed to a secondary transfer roller 5A as a secondary transfer unit via plural intermediate rollers 22A, 22B, 22C, 22D, and a registration roller 23, and the color images are batch-transferred onto the recording member PP. The recording member PP onto which the color images have been transferred is subjected to a fixing processing by a heat roll-type fixing device 24, and is held between paper discharge rollers 25, and placed on a paper discharge tray 26 outside the apparatus.

On the other hand, after the color images are transferred by a secondary transfer roller 5A onto a recording member PP toner remaining on the endless belt type intermediate transfer member 70 that has curvature-separated the recording member PP is removed by a cleaning unit 6A.

During the image forming processing, a primary transfer roller 5K is constantly in pressure contact with a photoreceptor 1K. Other primary transfer rollers 5Y, 5M, and 5C are in pressure contact respectively with the corresponding photoreceptors 1Y, 1M, and 1C only at the time of the color image forming.

The secondary transfer roller 5A is in pressure contact with the endless belt type intermediate transfer member 70 only at the time of performing the secondary transfer while the recording member PP passes through the secondary transfer roller 5A.

Further, an enclosure 8 is arranged to be drawn out from the apparatus main body A via support rails 82L and 82R.

The enclosure 8 has image forming sections 10Y, 10M, 10C, and 10K, and an endless belt type intermediate transfer unit 7.

The image forming sections 10Y, 10M, 10C, and 10K are arranged in tandem in the vertical direction. On the left side of the photoreceptors 1Y, 1M, 1C, and 1K shown in the cross-sectional diagram, an endless belt type intermediate transfer unit 7 is arranged. The endless belt type intermediate transfer unit 7 is composed of a rotatable endless belt type intermediate transfer member 70 by being wound on rollers 71, 72, 73, 74, 76, and 77, primary transfer rollers 5Y, 5M, 5C, and 5K, and a cleaning unit 6A.

When enclosure 8 is drawn out, image forming sections 10Y, 10M, 10C, and 10K, and an endless belt type intermediate transfer unit 7 are drawn out as one body from the main body A.

As described above, a toner image is formed on each of the photoreceptors 1Y, 1M, 1C, and 1K by charging, exposing, and developing, then the toner images of respective colors are superimposed on an endless belt type intermediate transfer member 70, and transferred collectively onto a recording member PP, and fixed by a heat roll-type fixing device 24 while applying pressure and heating rollers 270. Each of the photoreceptors 1Y, 1M, 1C, and 1K after the toner image is transferred onto a recording member PP, enters the above-described cycle of charging, exposing, and developing, and the succeeding image forming is performed after the toner that remains on the photoreceptors during the transfer is cleaned by a cleaning unit 6A.

<Transfer Material>

A transfer material used in the present invention is a support that holds a toner image, and is generally called an image support, a transfer material, or a transfer paper. Specific examples of the transfer material include plain paper from thin paper to thick paper, coated printing paper such as art paper, and coated paper, Japanese paper and postcard paper which are available on the market, plastic film for OHP, and various kinds of transfer materials such as cloth. In the present invention, in particular, a sheet having a basis weight in the range of 150 to 300 gsm, and having a surface shape with large irregularities, to which emboss processing or the like has been applied, can be preferably applied.

EXAMPLES

Hereinafter, Examples of the present invention will be described, but the present invention is not limited to the following Examples. In addition, the term "parts by mass" in the following description expresses parts by mass in terms of monomer or in terms of solid content unless otherwise specified.

<<Preparation of Intermediate Transfer Belt 1>>

[Synthesis of urethane acrylate A] The reaction was performed by charging 167 g of polypropylene glycol (molecular weight: 2000), 4.86 g of 2-hydroxyethyl acrylate, 5.79 g of isophthalic acid, 0.5 g of p-methoxyphenol as a polymerization inhibitor, and 0.05 g of dibutyltin dilaurate as a catalyst into a reaction vessel equipped with a condenser, a thermometer, a stirrer, a dropping funnel, and an air injection pipe, and raising the temperature to 70° C. while flowing air, and then adding 26.3 g of isophorone diisocyanate uniformly dropwise in 2 hours while stirring at 70 to 75° C. After the completion of the dropwise addition, the reaction was performed for around 5 hours, and then as a result of IR measurement, disappearance of isocyanate was confirmed, and the reaction was terminated. Urethane acrylate A that has polypropylene glycol, isophthalic acid, and isophorone diisocyanate as a repeating unit, and is an oligomer having an unsaturated double bond with polymerization properties at both ends was obtained.

[Substrate]

An intermediate transfer belt of bizhub PRESS C1100 manufactured by KONICAMINOLTA, INC. was used as the substrate.

[Formation of Elastic Layer]

Carbon black was kneaded into chloroprene rubber, then the compound was dissolved and dispersed in toluene, and a coating liquid for elastic layer formation 1 was prepared. Next, the coating liquid for elastic layer formation 1 was applied on the outer peripheral surface of the endless belt type substrate 1 by a dipping coating method, and dried, the resultant was vulcanized for 60 minutes to form an elastic layer 1 having a dry film thickness of 200 μm.

[Formation of Surface Layer]

Preparation of Coating Liquid for Surface Layer Formation 1

| The monomer composition and polymerization initiator composed of | |
|---|---|
| KAYARAD DPCA-30 (manufactured by Nippon Kayaku Co., Ltd. ) | 50 parts by mass |
| urethane acrylate A | 50 parts by mass |
| polymerization initiator: "IRGACURE184" (manufactured by BASF) | 4 parts by mass |

are added and dissolved into a solvent (ethyl acetate) so as to be 10% by mass in terms of monomer concentration, and a coating liquid for surface layer formation 1 was prepared.

The coating liquid for surface layer formation 1 was applied onto the outer peripheral surface of the elastic layer 1 by a dip coating method using a coating applicator to form a coating film such that the dry film thickness is 3 μm. The coating film was cured by irradiating with UV rays under the following irradiation conditions to form a surface layer, and consequently, an intermediate transfer belt 1 was obtained as the intermediate transfer member.

—Irradiation Condition of UV Rays—

Type of light source: high pressure mercury lamp "H04-L41" (manufactured by EYE GRAPHICS CO., LTD.)

Distance from irradiation port to surface of coating film: 100 mm

Irradiation dose: 1 J/cm$^2$

Movement speed of coating film to fixed light source (peripheral velocity): 60 mm/sec Irradiation time (time of rotating coating film): 240 seconds <<Preparation of Intermediate Transfer Belts 2 to 13>>

Each elastic layer and each surface layer were formed in the same manner as in the preparation of intermediate transfer belt 1 except that the kind and mass ratio (Ac/Uac) of the KAYARAD DPCA-30 (manufactured by Nippon Kayaku Co., Ltd.) that is polyfunctional acrylate (abbreviated as Ac in Table) in a coating liquid for surface layer formation and urethane acrylate (abbreviated as Uac in Table), and the thickness of the surface layer were changed as listed in Table 1, in the formation of the elastic layer 1 and surface layer 1, and each of the intermediate transfer belts 2 to 13 was obtained as the intermediate transfer member.

In addition, KAYARAD DPCA-30 and DPCA-60 were both manufactured by Nippon Kayaku Co., Ltd., and were a monomer having an unsaturated double bond other than urethane acrylate and an acrylate compound having 5 or more functional acrylic groups. Further, urethane acrylate, UV-1700B and UV-3000B manufactured by The Nippon Synthetic Chemical Industry Co., Ltd., pentaerythritol acrylate manufactured by Nippon Kayaku Co., Ltd., 4-acryloyl morpholine (manufactured by Wako Pure Chemical Industries, Ltd.) as the acryloyl morpholine, and trimethylolpropane triacrylate manufactured by TOKYO CHEMICAL INDUSTRY CO., LTD. were respectively used.

TABLE 1

| | Coating liquid for surface layer formation | | | Thickness |
|---|---|---|---|---|
| Intermediate transfer belt No. | Polyfunctional acrylate (Ac) | Urethane acrylate (Uac) | Ac/Uac [Mass ratio] | of surface layer [μm] |
| 1 | KAYARAD DPCA-30 | Urethane acrylate A | 50/50 | 3 |
| 2 | KAYARAD DPCA-30 | Urethane acrylate A | 50/50 | 5 |
| 3 | KAYARAD DPCA-60 | Urethane acrylate A | 50/50 | 2 |
| 4 | KAYARAD DPCA-60 | Urethane acrylate A | 50/50 | 3 |
| 5 | KAYARAD DPCA-60 | Urethane acrylate A | 60/40 | 2 |
| 6 | KAYARAD DPCA-30 | Urethane acrylate A | 70/30 | 3 |
| 7 | Pentaerythritol acrylate | Urethane acrylate A | 50/50 | 2 |
| 8 | KAYARAD DPCA-30 | Urethane acrylate UV-1700B | 50/50 | 2 |
| 9 | Acryloyl morpholine | Urethane acrylate UV-3000B | 40/60 | 2 |
| 10 | Pentaerythritol acrylate | Urethane acrylate A | 60/40 | 2 |
| 11 | Pentaerythritol acrylate | Urethane acrylate A | 60/40 | 5 |
| 12 | Trimethylolpropane triacrylate | Urethane acrylate A | 70/30 | 2 |
| 13 | Pentaerythritol acrylate | Urethane acrylate A | 70/30 | 2 |

<<Evaluation of Intermediate Transfer Belts 1 to 13>>

For each of the prepared intermediate transfer belts 1 to 13, the cracking resistance, the scraping resistance, the half-tone image quality, the transferability to paper with irregularities, the hardness and elastic modulus measured by a nano indentation method, and the universal hardness were evaluated.

<Cracking Resistance>

Each intermediate transfer belt was installed in "bizhub PRESS C1100" (manufactured by KONICA MINOLTA, INC.), and an endurance test of forming one million images having a printing ratio of 10% was performed.

The number of cracks per unit area (1 $mm^2$) at arbitrary 10 positions in each intermediate transfer belt after the above-described endurance test was counted, the average value (average number of cracks) at 10 positions was calculated, and evaluation was performed in accordance with the following evaluation criteria.

—Evaluation Criteria—

○: the number of cracks is 0 (accepted)

Δ: the average number of cracks is larger than 0 and less than 10 (accepted)

X: the average number of cracks is 10 or more (not accepted)

<Cracking Resistance>

Each intermediate transfer belt was installed in "bizhub PRESS C1100" (manufactured by KONICA MINOLTA, INC.), and an endurance test of forming one million images having a printing ratio of 10% was performed. Surface 10-point average roughness of each intermediate transfer belt was measured in accordance with JIS B0601 surface 10-point average roughness (Rz) before and after the endurance test, and evaluation was performed in accordance with the following evaluation criteria.

—Evaluation Criteria—

○: difference ΔRz of surface 10-point average roughness (Rz) is less than 0.5 μm (accepted)

Δ: difference ΔRz of surface 10-point average roughness (Rz) is 0.5 μm or more to less than 1.0 μm (accepted)

X: difference ΔRz of surface 10-point average roughness (Rz) is 1.0 μm or more (not accepted)

<Half-Tone Image Quality>

An evaluation apparatus obtained by installing each of the above-described intermediate transfer belts into an image forming apparatus "bizhub PRESS C1100" (manufactured by KONICA MINOLTA, INC.) was prepared, respectively, and by using each evaluation apparatus, a half-tone image in cyan color was output on Leathac paper (paper with irregularities). Evaluation was performed in accordance with the following evaluation criteria.

—Evaluation Criteria—

In the sheet of A3 size,

○: no white streaks having a length of 5 mm or more (accepted)

Δ: less than 3 white streaks having a length of 5 mm or more (accepted)

X: 3 or more white streaks having a length of 5 mm or more (not accepted)

<Transferability of Paper with Irregularities>

An evaluation apparatus obtained by installing each of the above-described intermediate transfer belts into an image forming apparatus "bizhub PRESS C1100" (manufactured by KONICA MINOLTA, INC.) was prepared, respectively, and by using each evaluation apparatus, 10 solid images having a toner density of 100% were output on Leathac paper (paper with irregularities). Each of the obtained solid images was read by a scanner to obtain the digital information, and by using an image editing and processing software ("Photoshop (registered trademark)" manufactured by Adobe Systems Incorporated), the average value of image density in each solid image was determined through image processing. Further, the area ratio of the area having 90% or less of the average value was determined in each solid image, and the average value of each intermediate transfer belt with the area ratio was calculated. This was set to the area ratio of an image density of 90% or less. Evaluation was performed in accordance with the following evaluation criteria.

—Evaluation Criteria—

○: the area ratio of an image density of 90% or less is less than 1% (accepted)

Δ: the area ratio of an image density of 90% or less is 1% or more to less than 5% (accepted)

X: the area ratio of an image density of 90% or less is 5% or more (not accepted)

<Measurement of Hardness and Elastic Modulus>

The hardness and elastic modulus measured by a nano indentation method, and the hardness specified in terms of universal hardness were measured by using the above-described measurement method.

The results are shown in Table 2.

TABLE 2

| Intermediate transfer belt No. | Nano indentation method Hardness [MPa] | Elastic modulus [MPa] | Universal hardness [MPa] | Cracking resistance | Scraping resistance | Half-tone image quality | Transferability of paper with irregularities | Note |
|---|---|---|---|---|---|---|---|---|
| 1 | 250 | 400 | 1.2 | ○ | ○ | ○ | ○ | Present invention |
| 2 | 340 | 550 | 1.2 | Δ | ○ | ○ | ○ | Present invention |
| 3 | 270 | 210 | 1.2 | ○ | Δ | ○ | ○ | Present invention |
| 4 | 250 | 400 | 1.8 | ○ | ○ | ○ | Δ | Present invention |
| 5 | 250 | 500 | 0.7 | Δ | ○ | ○ | ○ | Present invention |
| 6 | 320 | 500 | 1.0 | Δ | ○ | ○ | ○ | Present invention |
| 7 | 120 | 220 | 1.2 | ○ | X | X | X | Comparative Example |
| 8 | 350 | 700 | 1.2 | X | ○ | X | ○ | Comparative Example |
| 9 | 100 | 180 | 1.2 | ○ | ○ | ○ | X | Comparative Example |
| 10 | 250 | 500 | 0.4 | X | ○ | X | ○ | Comparative Example |
| 11 | 250 | 500 | 2.2 | ○ | ○ | ○ | X | Comparative Example |
| 12 | 450 | 700 | 3.5 | X | Δ | X | X | Comparative Example |
| 13 | 300 | 900 | 3.8 | Δ | X | X | X | Comparative Example |

As is apparent from Table 1, the intermediate transfer members 1 to 6 of the present invention obtained favorable results of the cracking resistance, the scraping resistance, the half-tone image quality, and the transferability of paper with irregularities, as compared with the intermediate transfer members 7 to 13 in Comparative Examples.

According to an embodiment of the present invention, an intermediate transfer member which generates less cracks and scrapes even if used repeatedly for paper having irregularities, and can transfer the secondary transfer image excellently can be provided. Further, an electrophotographic image forming apparatus arranged with the intermediate transfer member can be provided.

The development mechanism and action mechanism of the effect of an embodiment of the present invention are not clarified, but assumed as follows.

In general, when the hardness is high, the scraping is hardly generated but the cracking is easily generated. However, a surface layer is arranged on an elastic layer, and when the elastic modulus is decreased while maintaining the hardness on the surface of an intermediate transfer member, a state that the scraping is hardly generated but the cracking is hardly generated can be achieved. This is assumed because by decreasing the elastic modulus, stress is dispersed by the deformation when stress is applied, and the cracking can be prevented. Further, it is assumed that by setting the universal hardness to 0.5 to 2.0 MPa, the elastic layer is deformed by the stress of a secondary transfer nip portion, and follows a paper sheet, therefore, the transferability to paper with irregularities is improved.

Although the present invention has been described and illustrated in detail, it is clearly understood that the same is by way of illustrated and example only and is not to be taken byway of limitation, the scope of the present invention being interpreted by terms of the appended claims.

What is claimed is:

1. An intermediate transfer member used in an electrophotographic image forming apparatus having a unit of primary-transferring a toner image carried on an electrostatic latent image carrier to the intermediate transfer member, and then secondary-transferring the primary-transferred toner image onto a transfer material from the intermediate transfer member, wherein a surface of the intermediate transfer member has a hardness in the range of 150 to 350 MPa, and an elastic modulus in the range of 200 to 600 MPa, which are measured by a nano indentation method, and also has a hardness of 0.5 to 2.0 MPa specified in terms of universal hardness.

2. The intermediate transfer member according to claim 1, wherein the intermediate transfer member has a substrate layer, an elastic layer, and a surface layer.

3. The intermediate transfer member according to claim 2, wherein the surface layer contains a copolymer of urethane acrylate, and a monomer having an unsaturated double bond other than the urethane acrylate.

4. The intermediate transfer member according to claim 3, wherein the monomer having the unsaturated double bond other than the urethane acrylate is tetra- or more-functional acrylate.

5. The intermediate transfer member according to claim 3, wherein a mass ratio of the monomer having the unsaturated double bond other than the urethane acrylate/the urethane acrylate is in a range of 50/50 to 70/30.

6. The intermediate transfer member according to claim 2, wherein the elastic layer contains a thermoplastic elastomer, a vulcanized rubber, or a polymer material.

7. The intermediate transfer member according to claim 6, wherein the elastic layer contains the vulcanized rubber, and the vulcanized rubber is selected from the group consisting of natural rubber (NR), butadiene rubber (BR), acrylonitrile butadiene rubber (NBR), hydrogenated NBR (H-NBR), styrene butadiene rubber (SBR), isoprene rubber (IR), urethane rubber, chloroprene rubber (CR), chlorinated polyethylene (Cl-PE), epihalohydrin rubber (ECO, CO), butyl rubber (IIR), ethylene propylene diene polymer (EPDM), fluororubber, silicone rubber, and acrylic rubber (ACM).

8. The intermediate transfer member according to claim 2, wherein the elastic layer contains a conductive agent.

9. The intermediate transfer member according to claim 2, wherein the surface layer contains a resin formed from urethane acrylate.

10. An electrophotographic image forming apparatus comprising:

performing a process of primary-transferring a toner image carried on an electrostatic latent image carrier to an intermediate transfer member, and then secondary-transferring the primary-transferred toner image to a transfer material from the intermediate transfer member, wherein as the intermediate transfer member, the intermediate transfer member according to claim 1 is used.

* * * * *